US011363897B2

(12) United States Patent
Opheim

(10) Patent No.: US 11,363,897 B2
(45) Date of Patent: Jun. 21, 2022

(54) SPILL-PREVENTING HOLDER FOR A DISPOSABLE CUP WITH A DETACHABLE LID

(71) Applicant: Peter J. Opheim, Palmer, AK (US)

(72) Inventor: Peter J. Opheim, Palmer, AK (US)

( * ) Notice: Subject to any disclaimer, the term of this patent is extended or adjusted under 35 U.S.C. 154(b) by 4 days.

(21) Appl. No.: 16/676,052

(22) Filed: Nov. 6, 2019

(65) Prior Publication Data

US 2020/0260892 A1 Aug. 20, 2020

Related U.S. Application Data

(60) Provisional application No. 62/808,230, filed on Feb. 20, 2019.

(51) Int. Cl.
*A47G 23/02* (2006.01)

(52) U.S. Cl.
CPC ..... *A47G 23/0216* (2013.01); *B65D 2543/00046* (2013.01)

(58) Field of Classification Search
CPC ..... A47G 23/0216; A47G 2023/0283; B65D 1/265; B65D 41/00; B65D 41/0485; B65D 81/3876; B65D 81/3865; B65D 81/3881; B65D 2543/00046; Y10S 220/903; A47J 41/0061
USPC ..... 220/738, 636, 903, 592.17, 737, 739, 220/740; 206/499; 224/148.4, 148.7, 224/414; 62/457.3, 457.4
See application file for complete search history.

(56) References Cited

U.S. PATENT DOCUMENTS

| | | | | |
|---|---|---|---|---|
| 2,563,352 A | | 8/1951 | Morse | |
| 2,661,889 A | | 12/1953 | Phinney | |
| 2,863,585 A | | 12/1958 | Meshberg | |
| 3,285,455 A | * | 11/1966 | Pewitt | A47G 23/0241 215/395 |
| 3,285,456 A | * | 11/1966 | Pewitt | B65D 81/3876 215/395 |
| 4,596,370 A | * | 6/1986 | Adkins | B62J 11/00 224/414 |

(Continued)

OTHER PUBLICATIONS

Heat insulation handheld coffee sleeve for sale at https://www.amazon.com/dp/B07GCB58B4/ref=psdc_602608_t2_B07GNPPQ83, website printed Oct. 25, 2019.

(Continued)

*Primary Examiner* — Gideon R Weinerth
(74) *Attorney, Agent, or Firm* — Larry J. Guffey, Esq.; Oliver & Grimsley, LLC

(57) ABSTRACT

A spill-preventing holder, for a disposable cup to which is temporarily attached a lid that has an orifice in its top surface, includes: (a) a container having an interior volume and an upper rim that provides access to this interior volume which is adapted to accommodate the cup and its attached lid so that the lid is located proximate to the container's upper rim, and (b) a locking ring adapted, when the cup with its attached lid is situated within the container's interior volume, to: (i) detachably attach to the container, (ii) contact and apply pressure to the lid so as temporarily secure it to the cup, and (iii) provide access to the region of the environment surrounding the lid's orifice so as to allow one's mouth to be placed on the orifice for drinking a beverage contained within the cup.

16 Claims, 5 Drawing Sheets

(56) References Cited

U.S. PATENT DOCUMENTS

| | | | | | |
|---|---|---|---|---|---|
| 4,629,153 | A * | 12/1986 | Marcum | A47G 23/0266 | 108/46 |
| 4,720,023 | A * | 1/1988 | Jeff | A47G 19/2288 | 215/12.1 |
| 4,928,848 | A | 5/1990 | Ballway | | |
| 4,966,303 | A * | 10/1990 | Jones | A47G 23/0266 | 215/13.1 |
| 4,984,707 | A | 1/1991 | Fierthaler | | |
| 5,040,719 | A | 8/1991 | Ballway | | |
| 5,067,329 | A * | 11/1991 | Tomlinson | A47J 41/0044 | 62/457.4 |
| 5,531,353 | A | 7/1996 | Ward et al. | | |
| 5,628,453 | A | 5/1997 | MacLaughlin | | |
| 5,918,761 | A | 7/1999 | Wissinger | | |
| 5,921,431 | A * | 7/1999 | Pych | A47G 23/0241 | 215/393 |
| 6,155,452 | A * | 12/2000 | Laurent | B65D 81/3876 | 220/737 |
| 6,367,652 | B1 | 4/2002 | Toida et al. | | |
| D474,077 | S | 5/2003 | Hatsumoto | | |
| 7,380,685 | B2 | 6/2008 | Simmons et al. | | |
| D585,245 | S * | 1/2009 | Brouillette | A47G 19/2288 | D7/608 |
| 7,922,031 | B1 | 4/2011 | Prince | | |
| D640,090 | S | 6/2011 | Wisniewski | | |
| 8,061,551 | B2 | 11/2011 | Matlovich | | |
| D658,448 | S | 5/2012 | Ying | | |
| 8,381,935 | B1 | 2/2013 | Buck | | |
| 8,474,648 | B1 * | 7/2013 | Ritzen | A47J 41/0088 | 220/592.17 |
| 8,608,018 | B2 | 12/2013 | Babinsky et al. | | |
| 8,870,010 | B2 | 10/2014 | Buck | | |
| 8,919,592 | B2 | 12/2014 | Buck | | |
| D743,207 | S * | 11/2015 | Pendleton | A47G 23/0266 | D7/523 |
| 9,360,248 | B1 * | 6/2016 | Efferding | B65D 69/00 | |
| D808,736 | S * | 1/2018 | Acord | D7/608 | |
| D830,787 | S * | 10/2018 | Petrillo | B65D 81/3876 | D7/624.2 |
| D836,405 | S * | 12/2018 | Roberts | A47G 23/02 | D7/624.2 |
| 10,279,721 | B1 | 5/2019 | Nelson | | |
| 11,234,544 | B2 * | 2/2022 | Rivera | B65D 81/3881 | |
| 2003/0029876 | A1 | 2/2003 | Giraud | | |
| 2004/0031714 | A1 * | 2/2004 | Hanson | B65D 43/0212 | 206/505 |
| 2005/0211714 | A1 * | 9/2005 | Kazyaka | B60N 3/107 | 220/737 |
| 2008/0006643 | A1 * | 1/2008 | Ma | A47J 41/0011 | 220/592.16 |
| 2008/0173652 | A1 * | 7/2008 | Chou | B65D 1/265 | 220/592.17 |
| 2009/0020597 | A1 | 1/2009 | D'Amato | | |
| 2009/0166240 | A1 * | 7/2009 | Scarola | B65D 1/40 | 206/524.2 |
| 2009/0266737 | A1 * | 10/2009 | Cole | A47G 19/2272 | 206/499 |
| 2011/0062043 | A1 * | 3/2011 | Bougoulas | B65D 77/0486 | 206/514 |
| 2013/0264328 | A1 | 10/2013 | Ulvr | | |
| 2014/0209621 | A1 * | 7/2014 | Irish | B65D 21/083 | 220/739 |
| 2017/0119186 | A1 * | 5/2017 | Rivera | B65D 81/3881 | |
| 2017/0273483 | A1 * | 9/2017 | McArthur | B65D 43/0212 | |
| 2018/0335247 | A1 * | 11/2018 | Huisman | B65D 21/083 | |
| 2019/0274457 | A1 * | 9/2019 | Robertson | A47J 31/005 | |
| 2020/0260892 | A1 * | 8/2020 | Opheim | A47G 23/0216 | |
| 2021/0323753 | A1 * | 10/2021 | Welle | B65D 81/3883 | |

OTHER PUBLICATIONS

Tumbler sleeve carrier available for sale at https://www.amazon.com/dp/B07C3CMQNY/ref=psdc_602608_t1_B07GNPPQ83, website printed Oct. 25, 2019.

Joe Jacket Neoprene Drink Insulator, available for sale at https://www.amazon.com/Joe-Jacket-Neoprene-Insulator-Black/dp/B00ISV0RRO?ref_=fsclp_pl_dp_5, website printed Oct. 25, 2019.

Glass fsold at https://www.amazon.com/JOCO-Glass-Reusable-12oz-Coffee/dp/B00H9E3MHI/ref=pd_sim_79_1/135-5486454-6063260?_encoding=UTF8&pd_rd_i=B00H9E3MHI&pd_rd_r=e523d615-6ab0-11e9-8c99-472c1499fd9d&pd_rd_w=6f9E6&pd_rd_wg=p5DtT&pf_rd_p=90485860-83e9-4fd9-b838-b28a9b7fda30&pf_rd_r=KV8K6FX2GCG4J5AHNSAW&psc=1&refRID=KV8K6FX2GCG4J5AHNSAW printed Oct. 25, 2019.

Stainless steel resuable coffee cup available at https://www.amazon.com/Stainless-Reusable-Insulated-Perfect-Tumbler/dp/B07KYYQ9LD, website printed Oct. 25, 2019.

Camino Cup available for sale at https://madebyfressko.com/us/product/camino-snow/, website printed Oct. 25, 2019.

Double wall vacuum insulated tumbler available at https://www.amazon.com/RTIC-191-Insulated-Tumbler-Stainless/dp/B07572PCPG/ref=as_at?creativeASIN=B07572PCPG&linkCode=w61&imprToken=zmtdgJ.-KtTVsXLicBdnkA&slotNum=28&tag=drippedcoffee-20, website printed Oct. 25, 2019.

Hydro Flask available at https://www.amazon.com/Hydro-Flask-Insulated-Stainless-Graphite/dp/B01ACAURJQ/ref=as_at?creativeASIN=B01ACAURJQ&linkCode=w61&imprToken=zmtdgJ.-KtTVsXLicBdnkA&slotNum=25&tag=drippedcoffee-20, website printed Oct. 25, 2019.

Contigo SnapSeal Byron Vacuum Insulated mug available at https://www.amazon.com/Contigo-SnapSeal-Vacuum-insulated-Stainless/dp/B00IR77HG8/ref=as_at?creativeASIN=B00IR77HG8&linkCode=w61&imprToken=zmtdgJ.-KtTVsXLicBdnkA&slotNum=22&tag=drippedcoffee-20, website printed Oct. 25, 2019.

Thermos tumbler available at https://www.amazon.com/Thermos-Stainless-16-Ounce-Tumbler-Midnight/dp/B014MVAR50/ref=as_at?creativeASIN=B014MVAR50&linkCode=w61&imprToken=zmtdgJ.-KtTVsXLicBdnkA&slotNum=19&tag=drippedcoffee-20, website printed Oct. 25, 2019.

Zojirushi stainless steel mug available at https://www.amazon.com/Zojirushi-SM-KHE48AG-Stainless-Steel-16-Ounce/dp/B00GY0REZO/ref=as_at?creativeASIN=B00GY0REZO&linkCode=w61&imprToken=zmtdgJ.-KtTVsXLicBdnkA&slotNum=18&tag=drippedcoffee-20, website printed Oct. 25, 2019.

https://www.amazon.com/YETI-Rambler-Stainless-Insulated-Tumbler/dp/B00JP9AJC6/ref=as_at?creativeASIN=B00JP9AJC6&linkCode=w61&imprToken=zmtdgJ.-KtTVsXLicBdnkA&slotNum=15&tag=drippedcoffee-20, website printed Oct. 25, 2019.

Thermos beverage bottle for sale at https://www.amazon.com/Thermos-Vacuum-Insulated-Compact-Beverage/dp/B00JFB2RA6/ref=as_at?creativeASIN=B00JFB2RA6&linkCode=w61&imprToken=zmtdgJ.-KtTVsXLicBdnkA&slotNum=12&tag=drippedcoffee-20, website printed Oct. 25, 2019.

Zojirushi steel mug available at https://www.amazon.com/Zojirushi-SM-SA60-BA-Stainless-Steel-20-Ounce/dp/B00HYOGUM2/ref=as_at?creativeASIN-B00HYOGUM2&linkCode-w61&imprToken-zmtdgJ.-KtTVsXLicBdnkA&slotNum=9&tag=drippedcoffee-20, website printed Oct. 25, 2019.

Thermos bottle available at ttps://www.amazon.com/Thermos-SK2010MBTRI4-Stainless-Beverage-Midnight/dp/B0017IHRNM/ref–as_at?creativeASIN-B0017IHRNM&linkCode-w61&imprToken-zmtdgJ.-KtTVsXLicBdnkA&slotNum=6&tag=drippedcoffee-20, website printed Oct. 25, 2019.

Stanley Classic Vacuum Bottle available at https://www.amazon.com/dp/B001TI742Y/ref=as_at?creativeASIN=B001T1742Y&linkCode=w61&imprToken=zmtdgJ.-KtTVsXLicBdnkA&slotNum=3&tag=drippedcoffee-20, website printed Oct. 25, 2019.

Contigo travel mug available at https://www.amazon.com/Contigo-AUTOSEAL-Insulated-Stainless-Easy-Clean/dp/B00HZI5XBG/ref=as_at?creativeASIN=B00HZI5XBG&linkCode=w61&imprToken=zmtdgJ.-KtTVsXLicBdnkA&slotNum=0&tag=drippedcoffee-20, website Oct. 25, 2019.

KeepCup product available at https://us.keepcup.com/, website printed Oct. 25, 2019.

(56) References Cited

OTHER PUBLICATIONS

Starbucks reusable travel cup available at https://www.amazon.com/Starbucks-Reusable-Travel-Coffee-Grande/dp/B00IYO08DI, website printed Oct. 25, 2019.
https://www.amazon.com/Starbucks-Reusable-Plastic-Frosted-Stopper-2/dp/B07GV4394T/ref=asc_df_B07GV4394T/?tag=hyprod-20&linkCode=df0&hvadid=242030261655&hvpos=1o3&hvnetw=g&hvrand=12471344917503983438&hvpone=&hvptwo=&hvqmt=&hvdev=c&hvdvcmdl=&hvlocint=&hvlocphy=9007862&hvtargid=pla-524079324901&psc=1, website printed Oct. 25, 2019.
BYO Aztec Coffee Cup available at https://byocup.com.au/, website printed Oct. 25, 2019.
ECO Coffee Cup available at https://www.amazon.com/ECO-Coffee-Cup-Reusable-Travel/dp/B00G3OL4MU, website printed Oct. 25, 2019.

* cited by examiner

SPILL-PREVENTING HOLDER FOR A DISPOSABLE CUP WITH A DETACHABLE LID

CROSS-REFERENCE TO RELATED APPLICATIONS

This application and claims the benefit of Provisional Patent Application No. 62/808,230, filed Feb. 20, 2019 by the present inventor. The teachings of this application are incorporated herein by reference to the extent that they do not conflict with the teaching herein.

BACKGROUND OF THE INVENTION

1. Field of the Invention

The present invention relates generally to receptacles, and more particularly to a method and apparatus that prevents liquid spillage from a disposable cup that has a detachable lid.

2. Description of the Related Art

In the world of coffee, hot coffee-based beverages and related drinks, millions of these drinks are served every day in disposable paper cups with detachable lids. Disposable paper cups with such lids are convenient, but require careful handing, as the lids are prone to leak, prone to detach and cause spillage. Also, they can be easily crushed, and often provide no insulative properties.

To minimize these problems, many have turned to reusable tumblers, which can provide needed strength, security and insulation. However, these tumblers often are not convenient to use because they require cleaning between each use. Also, most reusable tumblers are lined with stainless steel, which can change the taste of the beverage, making it undesirable for some users.

U.S. patents that are representative of the prior art in this area include the following: U.S. Pat. Nos. 10,279,721; 8,919,592; 8,870,010; 8,608,018; 8,381,935; 7,922,031 and 6,367,652. None of these provide an adequate solution to the problems mentioned above.

Despite this prior art, there still continues to be a need for improved methods and apparatus that will solve the above-mentioned problems associated with the use of disposable cups which detachable lids.

SUMMARY OF THE INVENTION

Recognizing the need for the development of improved methods and apparatus that will solve the problems associated with the use of disposable cups which detachable lids (e.g., liquid spillage, no insulative properties for the liquids in the cups), the present invention seeks to provide such improved methods and apparatus.

In accordance with a preferred embodiment of the present invention, a spill-preventing holder, for a disposable cup to which is temporarily attached a lid that has an orifice in its top surface, includes: (a) a container having an interior volume and an upper rim that provides access to this interior volume which is adapted to accommodate the cup and its attached lid so that the lid is located proximate to the container's upper rim, and (b) a locking ring adapted, when the cup with its attached lid is situated within the container's interior volume, to detachably attach to the container.

Another preferred embodiment of the present invention further includes, where the lid has a bottom rim, the container having an interior surface with an adapter means. The container's adapter means is configured to, when the disposable cup, with its temporarily attached lid, is situated in the interior volume of the container, aid in temporarily locating the lid's bottom rim to be proximate to the container's upper rim.

Yet another preferred embodiment of the present invention further includes the container having an exterior surface with a locking portion or means that is located proximate the container's upper rim. Meanwhile, the locking ring has an inner surface that includes a ring attaching means. The container's locking portion and the locking ring's inner surface are both adapted to aid in temporarily attaching the locking ring to the container; as also is the ring attachment means.

Still another preferred embodiment of the present invention further includes the locking ring's inner surface being further adapted to, when the disposable cup, with its temporarily attached lid, is situated in the interior volume of the container, contact and apply pressure to the lid so as temporarily secure it onto the disposable cup.

Yet a further preferred embodiment of the present invention further includes the locking ring having a top rim with a top rim diameter and a bottom rim. The length between these rims defines the locking ring's height. Both the top rim diameter and the locking ring's height are adapted so as to, when the disposable cup, with its temporarily attached lid, is situated in the interior volume of the container, provide access to the region of the environment surrounding the lid's orifice so as to allow one's mouth to be placed on the orifice for drinking from the cup.

A final, representative embodiment of the present invention further includes the container's exterior surface having proximate its locking portion a plurality of container protrusions. Meanwhile, locking ring's exterior surface also has proximate its bottom rim a plurality of locking ring protrusions. Both sets of these protrusion are adapted to aid in holding and temporarily attaching the locking ring to the container.

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1:
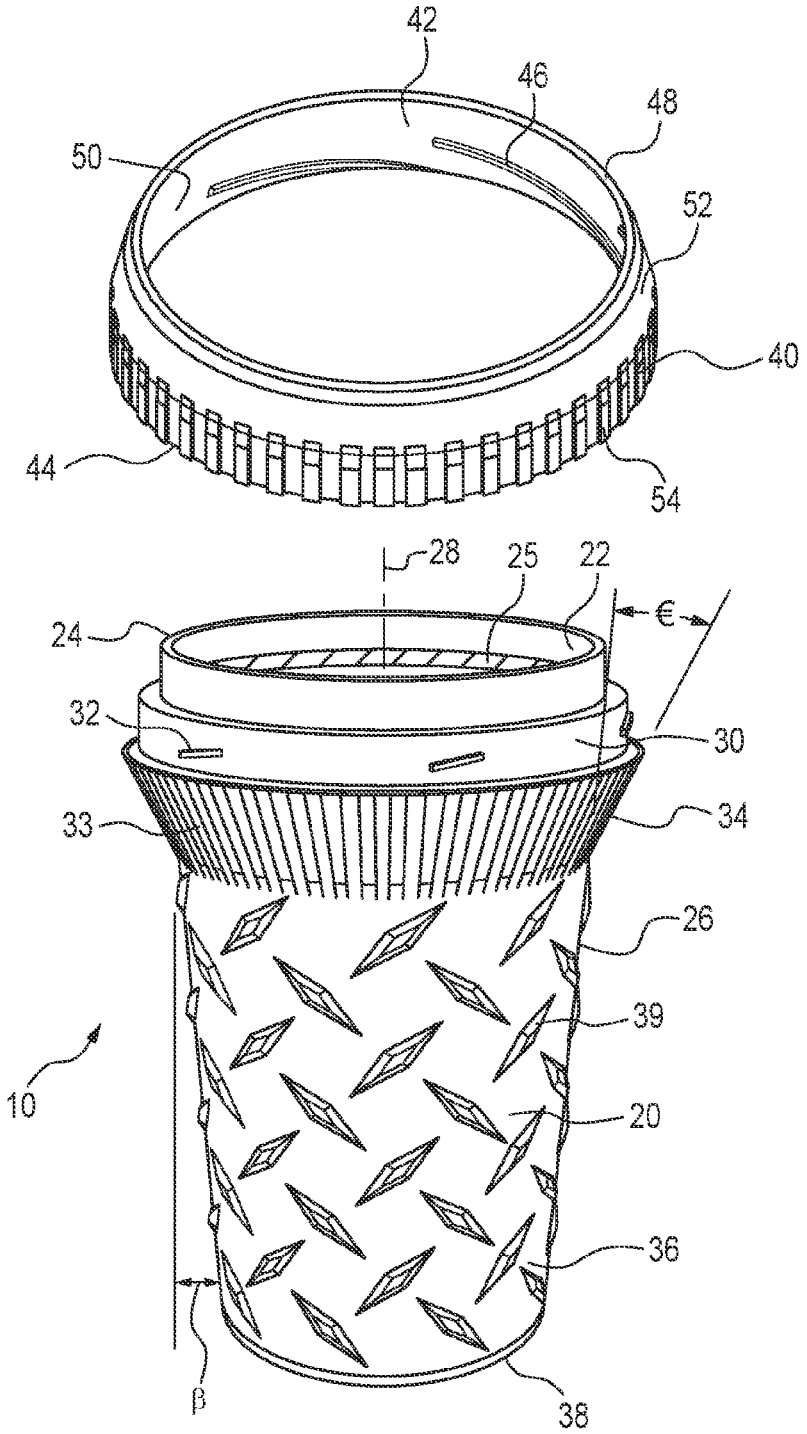
FIG. 1 is a perspective view of a preferred embodiment of the present invention that shows its two parts, i.e., its container and detachable locking ring which is shown above the top of the container.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 2:
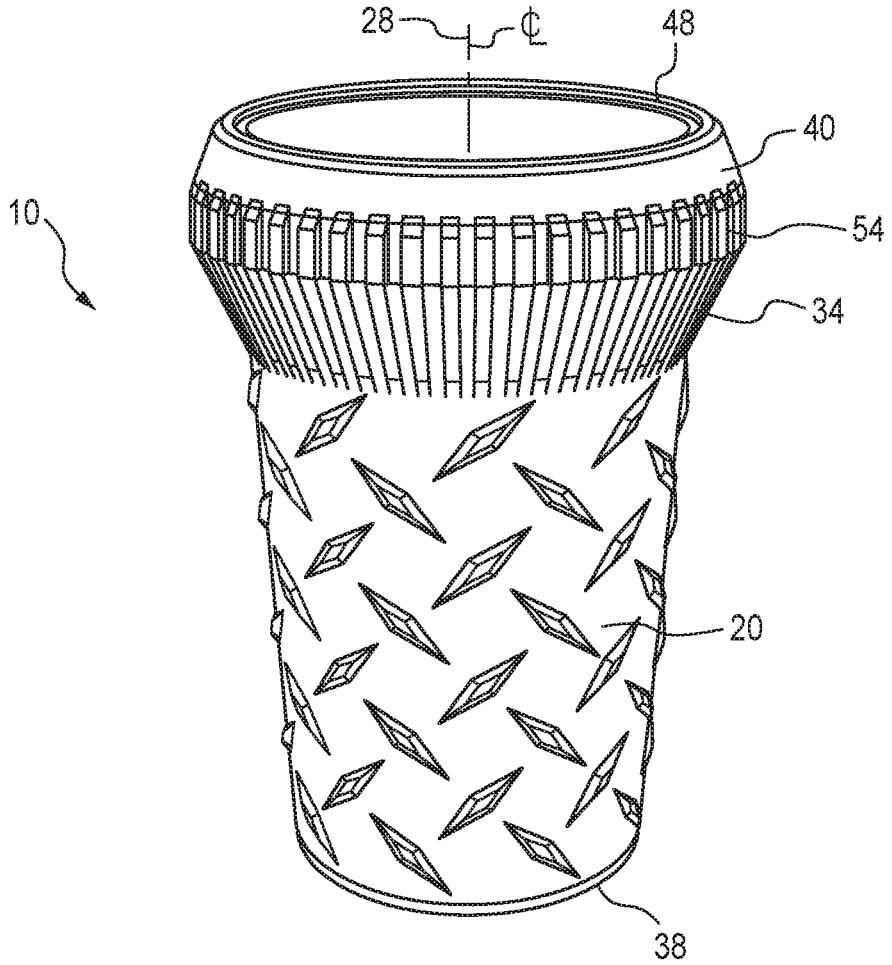
FIG. 2 is a similar perspective view to that shown in FIG. 1 but where the detachable locking ring has been attached to the top of the container.
Figure 3:
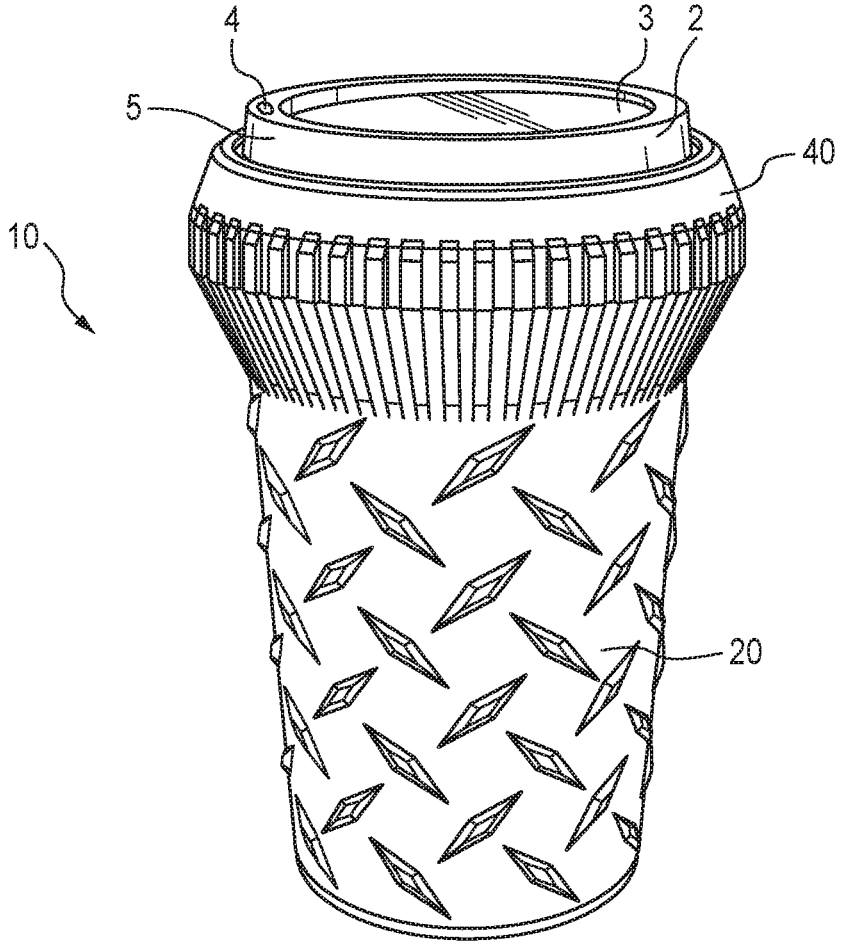
FIG. 3 is a perspective view of a preferred embodiment of the present invention after a lidded, disposable cup has been placed in the container and its locking ring attached to the container.

Referring to FIGS. 1 and 2, there is illustrated a perspective view of a preferred embodiment of the present invention. It is designed to be used with a beverage-containing, disposable cup 1 which has a detachable lid 2 with a top surface 3 having an orifice 4 that is adapted to allow one to place one's mouth over the orifice so as to drink from the disposable cup. The present invention is an insulated, spill-preventing holder 10 for such a lidded, disposable cup. See also FIG. 3.

The embodiment shown in FIGS. 1 and 2 has been described as preferred because it has been configured to work with the shape of the most commonly used disposable cup 1. The configuration of such a cup is best described, in geometrical terms, as having an exterior surface that is in the shape of a conical, right frustrum. This shape can be generally characterized by noting that a side view of it shows that its boundary takes the form of an isosceles trapezoid in which the lines that represent the cup's open top surface or upper rim and its bottom surface are parallel. Meanwhile, a top view of this disposable cup consists of two concentric circles where the circle with the larger diameter represents the open, top surface or upper rim of the cup and the circle with the smaller diameter represents the outer edge or perimeter of the bottom of the cup.

Figure 4:
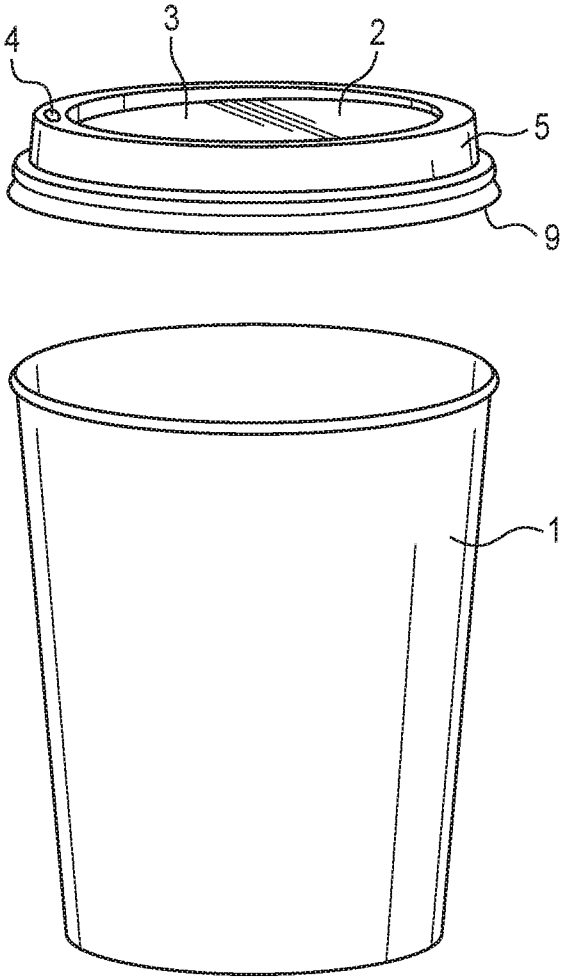
FIG. 4 is a perspective view of a typical disposable cup, with its detachable lid, that the present invention has been configured to hold and prevent the lid from coming off of the cup and thereby allowing a beverage to spill from the cup.

The sidewall of the cup has circular symmetry about its centerline which extends from the cup's bottom to its top rim so that the centerline bisects the planes of both the top rim and bottom surface at right angles and passes through the centers of the previously mentioned circles that represent the perimeters of the cup's upper rim and its bottom surface. The cup's sidewall is seen, in a side view of the cup, to taper inward at a uniform, cup sidewall taper angle (as measured from the cup's centerline) from the cup's larger diameter, upper rim to its smaller diameter, bottom surface. See FIG. 4.

The configuration of the cup's detachable lid 2 is similar to that of the cup itself, except that it's inverted and the length of lid's sidewall 5 is much shorter than that of the cup's sidewall and it sometimes consists of a similar top portion and an outward-directed ledge from which the bottom portion of the sidewall continues to extend downward to the lid's bottom rim 9. This detachable lid also has circular symmetry about its centerline that intersects at right angles its top surface 3 and the plane in which its open, bottom rim 9 lies. The lid's sidewall 5 and/or both portions of it will generally taper outward at a generally uniform, lid characteristic angle from the lid's smaller diameter, top surface to its larger diameter, bottom rim 9.

Figure 5:
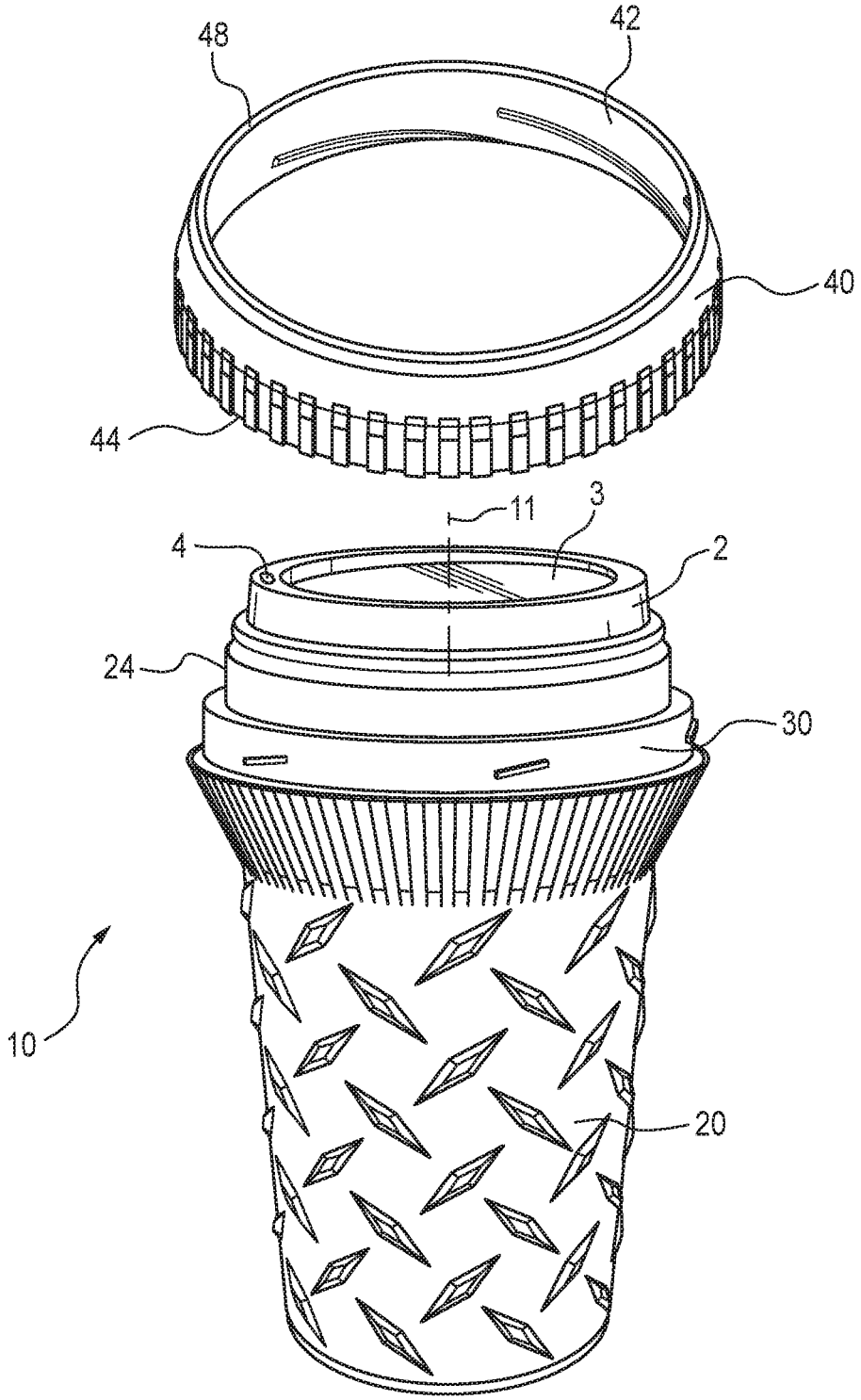
FIG. 5 is a perspective view of a preferred embodiment of the present invention that shows the situation where a disposable cup, that has its detachable lid adhered to it, has been placed within the container of the present invention, but its locking ring has not yet been attached to the top of the container.

The holder 10 of the present invention includes a container 20 with an open top onto which is temporarily attached a locking ring 40 after a lidded, disposable cup 1 has been placed in the container. The interior surface 22 of the container is configured so that it can fully accommodate the lidded, disposable cup and hold it in a precise position relative to the container such that a portion of the lid's top surface 3 extends to and above the container's upper rim 24. See FIG. 5.

The means for accomplishing this include: a) making the depth of the container so that it is approximately equivalent to that of the height of the disposable cup, (b) making the angle, ß, of the interior surface of the container's sidewall 26, relative to the container's centerline 28, slightly less than that of the disposable cup's sidewall taper angle so that the perimeter of the cup's bottom surface comes into contact with the container's interior surface at the required location below its upper rim, and (c) providing a ledge or adapter means 25 on the container's interior surface 22 so that it locates the disposable cup's bottom surface at the required height below the container's upper rim 24. Such an adapter means can also be configured (e.g., by using a circular array of inward-directed, elastic prongs that can bend outward to accept larger diameter cups) to accommodate a range of disposable cups having differing diameters.

The requirement that the container accommodate and hold the embodiment of the disposable cup described above requires many things pertaining to the shape and geometry of the container, including that: (a) the diameter of the container at its upper rim 24 be approximately equivalent to the diameter of the disposable cup at its upper rim, (b) the interior volume of the container be such that it can accommodate and fit a lidded, disposable cup within it so that a portion of the lid's top surface 3 extends to and above the container's upper rim 24, and (c) the general shape of the interior volume of the container is essentially a hollow, conical, right frustrum.

As shown in FIGS. 1-3 and 5, the exterior surface 36 of the container's sidewall has three, geometrically distinct portions. The first or lower portion of this surface is proximate the container's bottom and rises upward and outward, relative to the container's centerline 28, so that it, like the sidewall's interior surface, has a uniform sidewall taper angle, ß. Above this first portion is a second or gripping portion 33. This portion is distinguished by having its own distinct sidewall taper angle, relative to the container's centerline 28, that increases by another few degrees, €, from the ß taper angle that is on the lower or first portion of the exterior surface of the container's sidewall. Above this second portion and proximate the container's upper rim 24 is a locking or third portion 30 which is configured or adapted to allow the locking ring's inner surface 42 proximate its bottom rim 44 to be fitted over the container's locking portion 30 and temporarily and detachably affix the locking ring to the container.

The means for accomplishing the locking ring's temporary attachment to the container can include: (a) allowing the locking ring 40 to be screwed down and onto the container by having male screw threads or other attachment means 32 extending from the surface of this portion 30 which are configured to engage similar and opposite-configured, female threads or other means 46 that are positioned on the locking ring's inner surface 42, (b) in these same parts, utilizing snap-fit joints which would serve the same purpose of temporarily and detachably affix the locking ring to the container, (c) in these same parts, utilizing two or more clip mechanisms that would apply slight pressure when the locking ring is fastened to the container, and (d) using a hinge mechanism such that the locking ring would be hinged on one side where it connects to the locking ring and at its other end have a clip that would connect to the container; with the locking ring being "opened" to insert a disposable cup into the container, then the locking ring would be swung over a disposable cup's lid and the distal end of its clip mechanism secured by a clip to the container.

The shape or configuration of the holder's locking ring 40 is characterized by having it be such that it does not impede access to the region of the environment surrounding the lid's orifice so as to allow a cup user's mouth to be placed on the lid's orifice 4 to enable the user to drink from the lidded, disposable cup when it is situated within the holder's container. To enable this to happen, the height of the locking ring 40 between its top 48 and bottom 44 rims has to be set to be in a specific range, which is usually only a small percentage of the height of the disposable cup and generally comparable to the height of the disposable cup's lid 2. Additionally, the diameter of the locking ring's top rim must be larger enough so as to allow access to the lid's orifice.

To attach the locking ring to the container and ensure that it holds the cup's lid in place, the locking ring's inner surface 42 proximate its bottom rim has to have a holding portion 50 that is adapted or configured so as to allow the locking ring to be detachably fitted onto the cup's locking portion 30, while also allowing its especially configured inner surface to come into contact with a portion of the lid's sidewall 5 so as to put downward pressure on the lid' sidewall 5 so as to ensure that the lid stays in a locked-onto-the-top-of-the-disposable-cup position when the cup is being carried by the holder's container 20 and its locking ring 40 is engaged or in use; thereby preventing beverage spillage from the lidded cup when it is being transported in the present invention's holder 10.

For economy and ease of manufacturing, the container's sidewall 26 and bottom 38 usually have the same, relatively uniform thickness which is often set by the requirement that the container have certain thermal insulating properties. Additionally, both the container's exterior surface 36 and the locking ring's exterior surface 52 may have various sorts of protrusions 34, 54, 39 that are designed and adapted to enhance one's ability to grasp and hold and/or screw together the holder's container and locking ring.

Many materials are suitable for use in making this container and locking ring, these include aluminum, steel, polycarbonate, glass-filled plastic, and rubber, or any other suitable type of materials.

The foregoing is considered as illustrative only of the principles of the present invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is hereinafter set forth in the claims to the invention.

I claim:

1. A spill-preventing holder for beverage-containing, disposable cup, to which is attached a detachable lid that has a bottom rim and a top surface with an orifice that is adapted to allow one to drink from said disposable cup when said detachable lid is attached, said holder comprising:

a container having a bottom and a sidewall with an upper rim, and wherein said bottom and sidewall enclose an interior volume is accessible through said upper rim, wherein said sidewall has an exterior surface that includes: (a) a lower portion that is situated proximate said bottom and rises upward and outward relative to said container's centerline at a first sidewall taper angle, (b) a gripping portion that is situated above said lower portion and which continues to rise upward and outward relative to said container centerline at a second sidewall taper angle, and wherein said second sidewall taper angle is greater than said first sidewall taper angle, and (c) a locking portion that is situated above said gripping portion and includes said upper rim, wherein said interior volume of said container is adapted to accommodate said disposable cup in such a manner that, when said lid is temporarily attached to said disposable cup, said top surface of said lid is above and proximate the upper rim of said container, and a locking ring adapted to, when said disposable cup with a temporarily attached lid is situated within the interior volume of said container, detachably attach to said container so as to temporarily prevent said detachable lid from detaching from said disposable cup and also provide one access to said lid orifice.

2. The spill-preventing holder as recited in claim 1, wherein:

said container having an interior surface that includes an adapter means configured to locate said detachable lid to be in a position relative to said upper rim of said container so that said locking ring acts to prevent said detachable lid from temporarily detaching from said disposable cup.

3. The spill-preventing holder as recited in claim 2, wherein:

said locking portion includes an attachment means configured to aid in detachably attaching said locking ring to said container, and said locking ring having an inner surface that includes a ring attaching means for aiding in detachably attaching said locking ring to said container.

4. The spill-preventing holder as recited in claim 3, wherein:

said locking ring inner surface is further adapted to, when said disposable cup with a temporarily attached lid is situated within the interior volume of said container, contact and apply pressure to said lid so as temporarily prevent said detachable lid from detaching from said disposable cup.

5. The spill-preventing holder as recited in claim 3, wherein:

said locking ring having a top rim with a top rim diameter and a bottom rim, and the length between said rims is the height of said locking ring, said top rim diameter and said locking ring height are adapted so as to, when said disposable cup with a temporarily attached lid is situated within the interior volume of said container, provide access to a region of the environment surrounding said orifice so as to allow one's mouth to be placed on said orifice for drinking from said disposable cup.

6. The spill-preventing holder as recited in claim 4, wherein:

said locking ring having a top rim with a top rim diameter and a bottom rim, and the length between said rims is the height of said locking ring, said top rim diameter and said locking ring height are adapted so as to, when said disposable cup with a temporarily attached lid is situated within the interior volume of said container, provide access to a region of the environment surrounding said orifice so as to allow one's mouth to be placed on said orifice for drinking from said disposable cup.

7. The spill-preventing holder as recited in claim 2, wherein:

said locking ring having a top rim with a top rim diameter and a bottom rim, and the length between said rims is the height of said locking ring, said top rim diameter and said locking ring height are adapted so as to, when said disposable cups with a temporarily attached lid is situated within the interior volume of said container, provide access to a region of the environment surrounding said orifice so as to allow one's mouth to be placed on said orifice for drinking from said disposable cup.

8. The spill-preventing holder as recited in claim 1, wherein:

said locking portion includes an attachment means configured to aid in detachably attaching said locking ring to said container, and said locking ring having an inner surface that includes a ring attaching means for aiding in detachably attaching said locking ring to said container.

9. The spill-preventing holder as recited in claim 8, wherein:

said locking ring inner surface is further adapted to, when said disposable cup with a temporarily attached lid is situated within the interior volume of said container, contact and apply pressure to said lid so as temporarily prevent said detachable lid from detaching from said disposable cup.

10. The spill-preventing holder as recited in claim 9, wherein:

said locking ring having a top rim with a top rim diameter and a bottom rim, and the length between said rims is the height of said locking ring, said top rim diameter and said locking ring height are adapted so as to, when said disposable cup with a temporarily attached lid is situated within the interior volume of said container, provide access to a region of the environment surrounding said orifice so as to allow one's mouth to be placed on said orifice for drinking from said disposable cup.

11. The spill-preventing holder as recited in claim 9, wherein:

said exterior surface of the container has proximate its locking portion a plurality of container protrusions adapted to aid one in holding said container when said locking ring is being temporarily attached to said container.

12. The spill-preventing holder as recited in claim 10, wherein:

said exterior surface of the container has proximate its locking portion a plurality of container protrusions adapted to aid one in holding said container when said locking ring is being temporarily attached to said container.

13. The spill-preventing holder as recited in claim 8, wherein:

said locking ring having a top rim with a top rim diameter and a bottom rim, and the length between said rims is the height of said locking ring, said top rim diameter and said locking ring height are adapted so as to, when said disposable cup with a temporarily attached lid is situated within the interior volume of said container, provide access to a region of the environment surrounding said orifice so as to allow one's mouth to be placed on said orifice for drinking from said disposable cup.

14. The spill-preventing holder as recited in claim 13, wherein:

said exterior surface of the container has proximate its locking portion a plurality of container protrusions adapted to aid one in holding said container when said locking ring is being temporarily attached to said container.

15. The spill-preventing holder as recited in claim 8, wherein:

said exterior surface of the container has proximate its locking portion a plurality of container protrusions adapted to aid one in holding said container when said locking ring is being temporarily attached to said container.

16. The spill-preventing holder as recited in claim 1, wherein:

said locking ring having a top rim with a top rim diameter and a bottom rim, and the length between said rims is the height of said locking ring, said top rim diameter and said locking ring height are adapted so as to, when said disposable cup with a temporarily attached lid is situated within the interior volume of said container, provide access to a region of the environment surrounding said orifice so as to allow one's mouth to be placed on said orifice for drinking from said disposable cup.

* * * * *